US005398820A

United States Patent [19]

Kiss

[11] Patent Number: 5,398,820

[45] Date of Patent: Mar. 21, 1995

[54] DOLL-HOLDER WALL MOUNT

[76] Inventor: Howard M. Kiss, 2526 Wilmette Ave., Titusville, Fla. 32780

[21] Appl. No.: 180,967

[22] Filed: Jan. 14, 1994

[51] Int. Cl.[6] ..... A47F 7/00

[52] U.S. Cl. ..... 211/13

[58] Field of Search ..... 211/13, 39, 89; 248/460, 461, 126; 446/268

[56] References Cited

U.S. PATENT DOCUMENTS

| | | | |
|---|---|---|---|
| D. 287,386 | 12/1986 | Kaiser et al. | D21/189 |
| 316,062 | 4/1885 | Riessner . | |
| 414,231 | 11/1889 | Loring | 248/460 X |
| 440,201 | 11/1890 | Servus | 248/460 X |
| 646,969 | 4/1900 | Folger | 211/39 |
| 698,272 | 4/1902 | Glover | 211/39 |
| 1,236,676 | 8/1917 | Coventry . | |
| 1,879,251 | 9/1932 | Horbatuk | 248/460 X |
| 3,095,092 | 6/1963 | Magarian | 211/89 X |
| 3,154,281 | 10/1962 | Frank | 248/201 |
| 3,512,741 | 5/1970 | Goldstein | 248/206 |
| 3,946,877 | 3/1976 | Galicia | 211/65 |
| 5,080,240 | 1/1992 | Williams | 211/87 X |

*Primary Examiner*—Alvin C. Chin-Shue
*Assistant Examiner*—Sarah L. Purol
*Attorney, Agent, or Firm*—Michael K. Gray

[57] ABSTRACT

A doll holder wall mount having a planar wall mount to which are connected a plurality of doll holder members equipped with m-shaped doll grips for holding a doll in the contact region of the m-shaped doll grips. A flange overhang is integrally connected to the wall mount and is provided with wall-hanging crevices for engaging nails attached to a wall. The doll holder wall mount has screwable support members for engaging support member receptacles attached to the back of the planar wall mount to allow the doll holder wall mount to be supported on a level surface if desired.

12 Claims, 2 Drawing Sheets

DOLL-HOLDER WALL MOUNT

BACKGROUND OF THE INVENTION

The present invention pertains to doll holders. More particularly the present invention pertains to a doll holder having means for mounting a plurality of dolls on a wall and having means for supporting a plurality of dolls on a table or level surface if so desired.

DISCUSSION OF THE BACKGROUND

An examination of a typical young ladies bedroom will often reveal the presence of several dolls strewn around the floor. The tidy young lady, although not having her dolls strewn about the floor, will nonetheless, have her dolls stacked on closet shelves or compressed in toy chests. Such a practice makes access of the dolls difficult as well as being potentially damaging for the dolls.

Collectors of dolls have traditionally had difficulty storing and cataloging their doll collections in a neat and ordered fashion. Further, the collector has had the problem of trying to maximize the available space for storing his or her collection of dolls and desires a means for displaying a plurality of dolls in a space-efficient manner.

Thus, a need is seen for a doll-holder device which can accommodate and support a plurality of dolls, and which can be mounted on a wall or be utilized on a table or flat surface.

SUMMARY OF THE INVENTION

Accordingly, one object of the present invention is to provide a doll-holder upon which a plurality of dolls can be secured and mounted on a wall.

Yet another object of the present invention is to provide a doll-holder which can hold a plurality of dolls and which is equipped with means for allowing the doll-holder to stand on a table or level surface.

These and other valuable objects and advantages are provided by a doll holder wall mount. The doll holder wall mount is provided with a planar wall mount having a front and back side. Doll holder means are connected to the wall mount. The doll holder means can be integral with the wall mount or can be snapped to the wall mount through holes provided in the wall mount. Alternatively, slots can be provided in the wall mount and the doll holder means can be slidably attached to the slots.

An overhanging flange is integrally connected to the wall mount and is provided with means for securing the wall mount to the wall (i.e., means for engaging nails attached to a wall). The doll holder wall mount of the present invention is further provided with means for supporting the wall mount on a level surface.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

When referring to the drawings, it should be understood that like reference numerals designate identical or corresponding parts throughout the respective references.

DETAILED DESCRIPTION OF THE INVENTION

Figure 1:
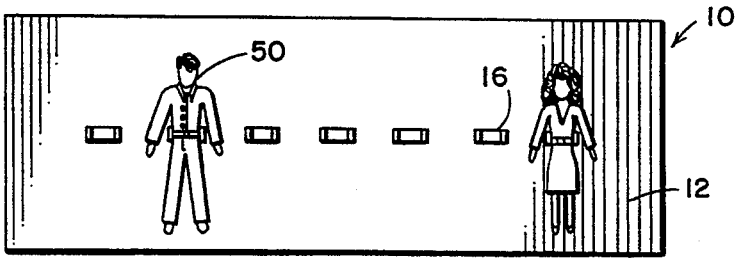
FIG. 1 is a plan, frontal view of the doll-holder wall mount according to a first embodiment of the present invention.

With reference to FIG. 1, a doll-holder wall mount 10, according to a first embodiment of the present invention, is comprised of a wall-mount 12 having a plurality of doll-holder members 16 which are integrally attached to the wall-mount 12.

The wall-mount 12 is a planar element having a substantially rectangular shape. In the preferred embodiment of the present invention, the wall-mount and the doll-holder members are sized to accommodate "BARBIE TM"-type dolls such as those sold and manufactured by Mattel, Inc. However, the teachings of the present invention can be utilized in doll holders which can accommodate dolls of a variety of shapes and sizes.

Figure 2A:
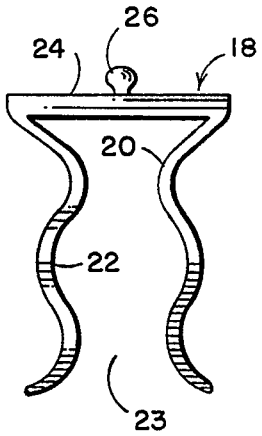
FIG. 2A is an overhead view of the detachable doll-holder member according to the second embodiment of the present invention.
Figure 2:
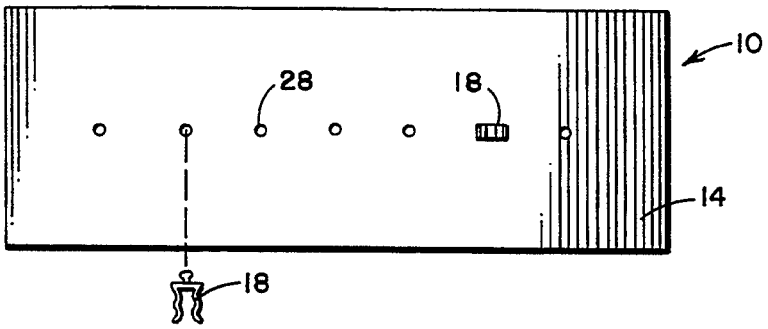
FIG. 2 is a plan, frontal view of the doll-holder wall mount according to a second embodiment of the present invention.

With reference to FIG. 2, the doll-holder wall mount 10 is comprised of a wall mount 14, similar to wall mount 12, with wall mount 14 having a plurality of apertures 28 for accommodating a plurality of snap-fit doll holder members 18, respectively.

The snap-fit doll holder members 18 (FIG. 2A) are integrally comprised of two M-shaped doll grips 20 with each doll grip 20 being integrally connected to a base 24 at opposite ends of the base 24. A doll (e.g., doll 50 of FIG. 1) can be inserted through the opening 23 between the respective doll grips 20.

The doll holder members 16 of FIG. 1 are identical in shape to the snap-fit doll holder members 18 with the difference being that doll holder members 16 are integral with wall mount 12 whereas the snap-fit doll holder members 18 are snap-fitted into wall mount 14.

The elastic properties of the doll grips 20 allow the doll 50 to be inserted through opening 23 and secured to the doll holder member 18 at the contact regions 22 which are located in the center of the respective M-shaped doll grips 20. A snap protrusion 26 of the snap-fit doll holder member 18 is integrally connected to the base 24. The snap-fit doll holder members 18 are securable to the wall mount 14 by inserting the snap protrusions 26 of the doll holder members 18 into the respective apertures 28 of the wall mount 14.

The snap-fit doll holder members are thus easily attachable and detachable from the wall mount 14.

Figure 3:
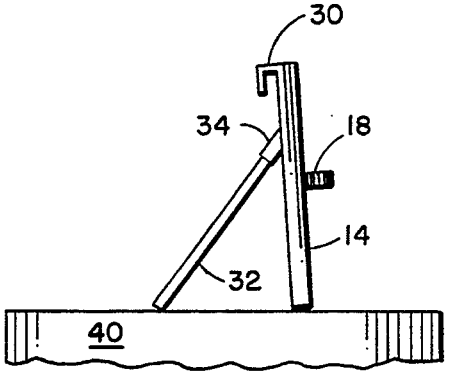
FIG. 3 is a side-view of the doll-holder wall mount of the present invention in accordance with the first and second embodiments of the invention.
Figure 4:
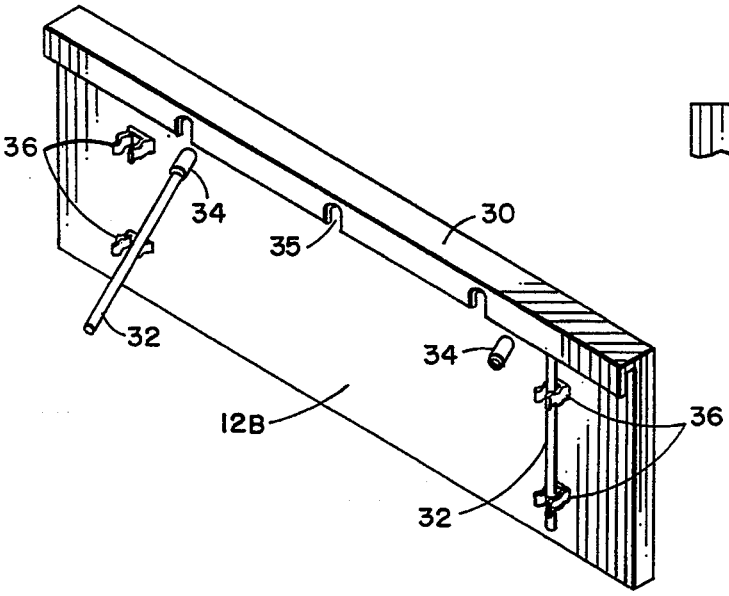
FIG. 4 is a perspective, rear view of the present invention in accordance with the first and second embodiments.

With reference to the side and rear views of FIGS. 3 and 4, the wall mount 14 is integrally connected to a flange overhang 30. In FIG. 3, the wall mount 14 is being supported on a table 40 by means of support member 32 which is a rod-like member having a threaded end 33 for purposes of being screwably connected to support member receptacle 34. As an alternative, instead of being provided with a threaded end 33, the support member 32 can be designed to be friction fitted to the support member receptacle 34.

Support member receptacle 34 is integrally connected to the back 12B of wall mount 12. As FIG. 4 demonstrates, the flange overhang 30 is provided with wall-hanging crevices 35 which can be utilized for hanging the doll holder wall mount 10 on a wall. When the doll holder wall mount 10 is hung on a wall, the support members 32 are intended to be snap fitted and secured by snap fittings 36. Snap fittings 36 are positioned under the flange overhang 30 in such a manner that the snap fittings 36 do not make wall contact when the wall mount 10 is hung upon a wall.

Figure 5:
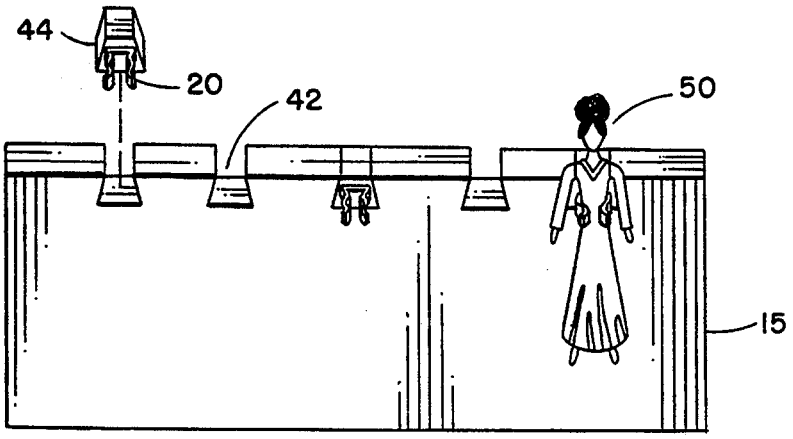
FIG. 5 is a perspective, frontal view of the doll-holder wall mount according to a third embodiment of the present invention.
Figure 5A:
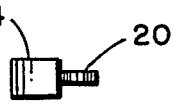
FIG. 5A is a side-view of the slot-fit doll-holder member according to the third embodiment of the present invention.

With reference to FIG. 5, the doll holder wall mount 10 according to a third embodiment of the present invention has a wall mount 15 provided with a plurality of triangle-base slots 42 which are for purposes of accommodating and securing slot-fit doll holder members 44. The slot fit doll holder members 44 are shaped to fit into the triangle base slots 42. The slot fit doll holder members 44 are provided with the M-shaped doll holder members 20 as are the doll holder members 16 and 18 of the first and second embodiments of the invention. The slot fit doll holder members 44 allow dolls to be attached and connected to the wall mount 15 as desired.

Figure 6:
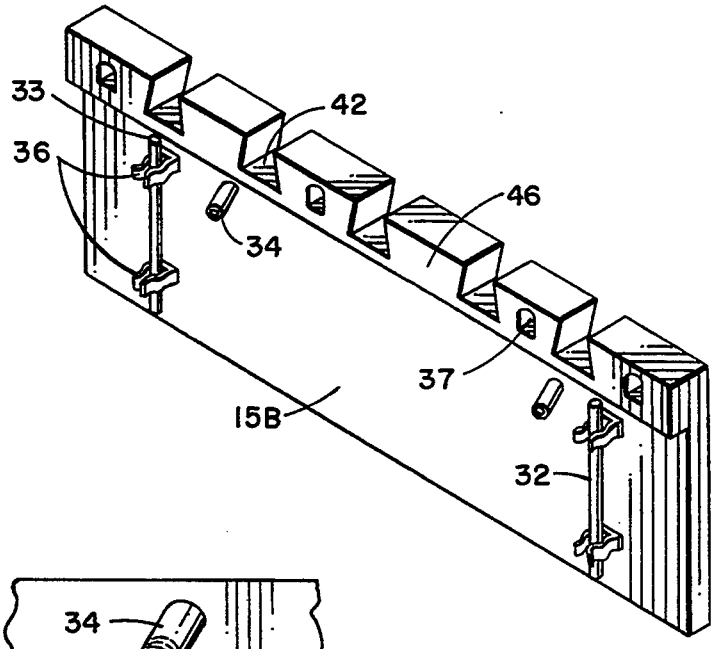
FIG. 6 is a perspective, rear view of the doll-holder wall mount according to the third embodiment of the present invention.

With reference to FIG. 6, the back 15B of wall mount 15 is provided with support members 32 and support member receptacles 34 as in the first and second embodiments.

Figure 7:
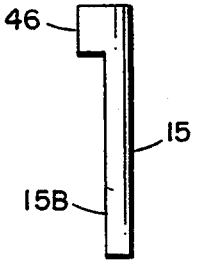
FIG. 7 is a side-view of the wall mount of the present invention illustrated in FIG. 6.
Figure 8:
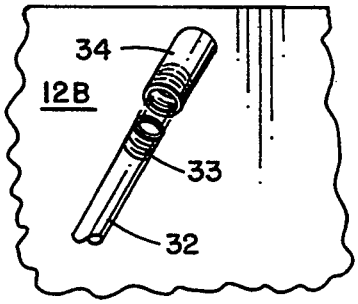
FIG. 8 is an exemplary partial see-through illustration of the threaded end of a support member which is screwably connected to a support member receptacle according to one embodiment of the present invention.
Figure 9:
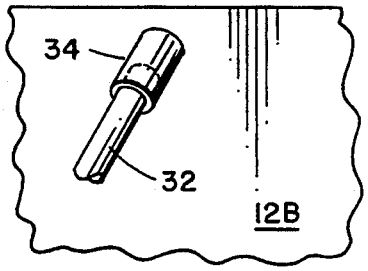
FIG. 9 is an exemplary partial see-through illustration of a support member which is friction fitted to a support member receptacle according to another embodiment of the present invention.

With reference to FIG. 7, wall mount 15 is provided with an integrally connected overhang region 46 with wall-hang apertures 37 being provided in the overhang region 46 to facilitate the mounting of the wall mount 15 to a wall.

The respective wall mounts 12, 14 and 15 can be made of a plastic or synthetic rubber compounds. Each doll holder member 16, each snap fit doll holder member 18, and each slot fit doll holder members 44 all are provided with two M-shaped doll grips 20. The M-shaped doll grips 20 should have elastic properties so that the doll grips 20 will return to their resting state positions upon a doll being inserted between them.

The present invention is intended to provide easy storage and facilitate display of dolls for the benefit of amateur and professional doll enthusiasts, young and old alike.

The foregoing detailed description of the present invention is intended to be illustrative and non-limiting. Many changes and modifications are possible in light of the above teachings. Thus, it is understood that the invention may be practiced otherwise than is specifically described herein and still be within the scope of the appended claims.

What is claimed is:

1. A doll holder wall mount, comprising:

a wall mount having a front and back side;

doll holder means, for securing a doll thereto, connected to said wall mount at the front side of said wall mount;

a flange overhang integrally connected to said wall mount having means for securing said wall mount to a wall;

means for supporting said wall mount on a level surface; and wherein said means for supporting said wall mount on a level surface comprises a support member connected to a support member receptacle, said support member receptacle being connected to said back side of said wall mount.

2. A doll holder wall mount according to claim 1, wherein said doll holder means comprises:

a plurality of doll holder members integrally connected to said wall mount with each of said doll holder members having two M-shaped doll grips for securing a doll therebetween in a contact region of said two M-shaped doll grips.

3. A doll holder wall mount according to claim 1, wherein said doll holder means comprises:

a plurality of snap fit doll holder members, with each snap fit doll holder member having a snap protrusion for engaging an aperture in said wall mount.

4. A doll holder wall mount according to claim 3, wherein each of said snap fit doll holder members comprises:

a base connected to said snap protrusion;

a first M-shaped doll grip connected at one end of said base;

a second M-shaped doll grip connected to the other end of said base.

5. A doll holder wall mount according to claim 1, wherein said wall mount has a plurality of slots.

6. A doll holder wall mount according to claim 5, wherein said doll holder means comprises a slot fit doll holder member.

7. A doll holder wall mount according to claim 5, wherein said plurality of slots are triangle-base slots.

8. A doll holder wall mount according to claim 1, wherein said means for securing said wall mount to a wall comprises a plurality of wall hang crevices formed in said flange overhang.

9. A doll holder wall mount according to claim 1, wherein said flange overhang has a plurality of wall hang apertures.

10. A doll holder wall mount according to claim 1, further comprising:

a plurality of snap fits connected to said back side of said wall mount for engaging said support member when said support member is not engaged with said support member receptacle.

11. A doll holder wall mount, comprising:

a wall mount having a front and back side;

doll holder means, for securing a doll thereto, connected to said wall mount at the front side of said wall mount;

a flange overhang integrally connected to said wall mount having means for securing said wall mount to a wall;

means for supporting said wall mount on a level surface; and wherein said means for supporting said wall mount on a level surface comprises a support member having a threaded end and a support member receptacle connected to said back side of said wall mount for engaging the threaded end of said support member so as to secure said support member thereto.

12. A doll holder wall mount, comprising:

a wall mount having a front and back side;

doll holder means, for securing a doll thereto, connected to said wall mount at the front side of said wall mount;

a flange overhang integrally connected to said wall mount having means for securing said wall mount to a wall;

means for supporting said wall mount on a level surface; and wherein said means for supporting said wall mount on a level surface comprises a support member friction fitted to a support member receptacle connected to said back side of said wall mount so as to secure said support member thereto.

* * * * *